US006443700B1

(12) United States Patent
Grylls et al.

(10) Patent No.: US 6,443,700 B1
(45) Date of Patent: Sep. 3, 2002

(54) TRANSPIRATION-COOLED STRUCTURE AND METHOD FOR ITS PREPARATION

(75) Inventors: Richard John Grylls; Curtiss Mitchell Austin, both of Loveland, OH (US); Kevin Swayne O'Hara, Boxford, MA (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/708,955

(22) Filed: Nov. 8, 2000

(51) Int. Cl.[7] ..... B63H 1/26

(52) U.S. Cl. ..... 416/229 R; 416/232; 416/241 R; 416/241 B; 427/377; 428/304.4

(58) Field of Search ..... 416/229 R, 229 A, 416/232, 241 R, 241 B, 97 A, 96 R, 97 R, 231; 415/115; 428/304.4, 613; 427/377

(56) References Cited

U.S. PATENT DOCUMENTS

| | | | | |
|---|---|---|---|---|
| 3,963,368 A | | 6/1976 | Emmerson | |
| 4,004,056 A | | 1/1977 | Carroll | |
| 4,042,162 A | | 8/1977 | Meginnis et al. | |
| 4,245,769 A | | 1/1981 | Meginnis | |
| 4,273,824 A | * | 6/1981 | McComas et al. | 428/256 |
| 4,673,435 A | | 6/1987 | Yamaguchi et al. | |
| 4,764,089 A | * | 8/1988 | Strangman | 415/174 |
| 4,914,794 A | * | 4/1990 | Strangman | 29/889.2 |
| 5,214,011 A | | 5/1993 | Breslin | |
| 5,223,332 A | * | 6/1993 | Quets | 428/216 |
| 5,295,530 A | | 3/1994 | O'Connor et al. | |
| 5,514,482 A | * | 5/1996 | Strangman | 428/623 |
| 5,518,061 A | | 5/1996 | Newkirk et al. | |
| 5,538,796 A | * | 7/1996 | Schaffer et al. | 428/469 |
| 5,545,484 A | * | 8/1996 | Yamaguchi et al. | 428/408 |
| 5,728,638 A | | 3/1998 | Strange et al. | |
| 5,876,860 A | * | 3/1999 | Marijnissent et al. | 428/623 |

* cited by examiner

*Primary Examiner*—F. Daniel Lopez
*Assistant Examiner*—James M McAleenan
(74) *Attorney, Agent, or Firm*—David L. Narciso

(57) ABSTRACT

A structure includes a cooled article having an open-cell solid foam of ceramic or metal cell walls with a porous interconnected intracellular volume therebetween. A source of a pressurized gas is in communication with a source region of the cooled article. The source of the pressurized gas includes a gas plenum in gaseous communication with the source region, and a compressor having a compressed gas output in gaseous communication with the gas plenum. Gas flows from the source of the pressurized gas through the porous intracellular volume, to cool the cooled article.

23 Claims, 4 Drawing Sheets

TRANSPIRATION-COOLED STRUCTURE AND METHOD FOR ITS PREPARATION

BACKGROUND OF THE INVENTION

Many portions of engines, such as gas turbine engines, become extremely hot during service. Some components are contacted by hot combustion gases whose temperatures exceed the melting points of the materials of construction of the components. A number of techniques are used to allow the components to operate under such conditions. In one, the surface of the material is insulated by a protective thermal barrier coating.

In another technique, the component is actively cooled by a flow of cooling air that passes over its surface to allow it to continue functioning. High pressure turbine blades, for example, are typically hollow and have surface openings therethrough. Compressed cool air is passed into the hollow interior of the turbine blades and exits through the surface openings. The air streams along the surfaces of the turbine blades to both cool the surfaces and provide a cool-air film layer between the hot combustion gas and the metal of the turbine blade. In a related approach, a jet of cool air may be directed against the surface of an article to be cooled.

Transpiration cooling has also been used. The article to be cooled is made to be porous. Compressed cooling air is forced through the porous article to remove heat. Transpiration cooling has an advantage that the cooler air remains in contact with the material of the article for a relatively long period of time so that a significant amount of heat may be transferred into the air and thence removed from the article.

A number of techniques are known for fabricating an article having a porous structure. The techniques are relatively cumbersome and time-consuming to practice, so that the cost of the article is high. Consequently, they have not found widespread use in gas turbine and other applications. If the advantages of transpiration cooling are to be realized in practice, there is a need for an improved material and method for its preparation.

BRIEF SUMMARY OF THE INVENTION

The present invention provides a structure including a porous article that is transpiration cooled. It is suitable for applications in gas turbine and other types of engines. The porous article is prepared much more economically than prior types of porous articles suitable for such uses.

A structure comprises a cooled article comprising an open-cell solid foam of cell walls having a porous interconnected intracellular volume therebetween. The cell walls are formed of a material selected from the group consisting of a metal and a ceramic. A source of a pressurized gas is in communication with a source region of the cooled article. The source of the pressurized gas may comprise a gas plenum in gaseous communication with the source region, and a compressor having a compressed gas output in gaseous communication with the gas plenum.

The structure typically is a portion of an engine, such as a gas-turbine engine. In a gas turbine engine, components such as a gas-turbine blade, a gas-turbine vane, or a gas-turbine stationary shroud may benefit from this approach.

The cell walls may be a ceramic or a metal such as a nickel-base metallic alloy. In some embodiments, at least some of the cell walls are a ceramic and some of the cell walls are a metal. The ceramic material comprises a base ceramic such as aluminum oxide. The cooled article comprises at least about 60 volume percent of ceramic, most preferably from about 60 to about 80 percent by volume of ceramic.

A method of preparing a structure which includes an open-cell solid foam article comprises the steps of providing a piece of a sacrificial ceramic having the shape of a cooled article, and contacting the piece of the sacrificial ceramic with a reactive metal which reacts with the sacrificial ceramic to form an open-celled ceramic foam article.

The article comprises ceramic cell walls of an oxidized ceramic of the reactive metal, and a porous interconnected intracellular volume therebetween filled with an intracellular metal. At least a portion of one of the ceramic cell walls and the intracellular metal of the article is removed to form a transpiration volume. A source of a pressurized gas is placed in gaseous communication with a source region of the transpiration volume of the cooled article.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
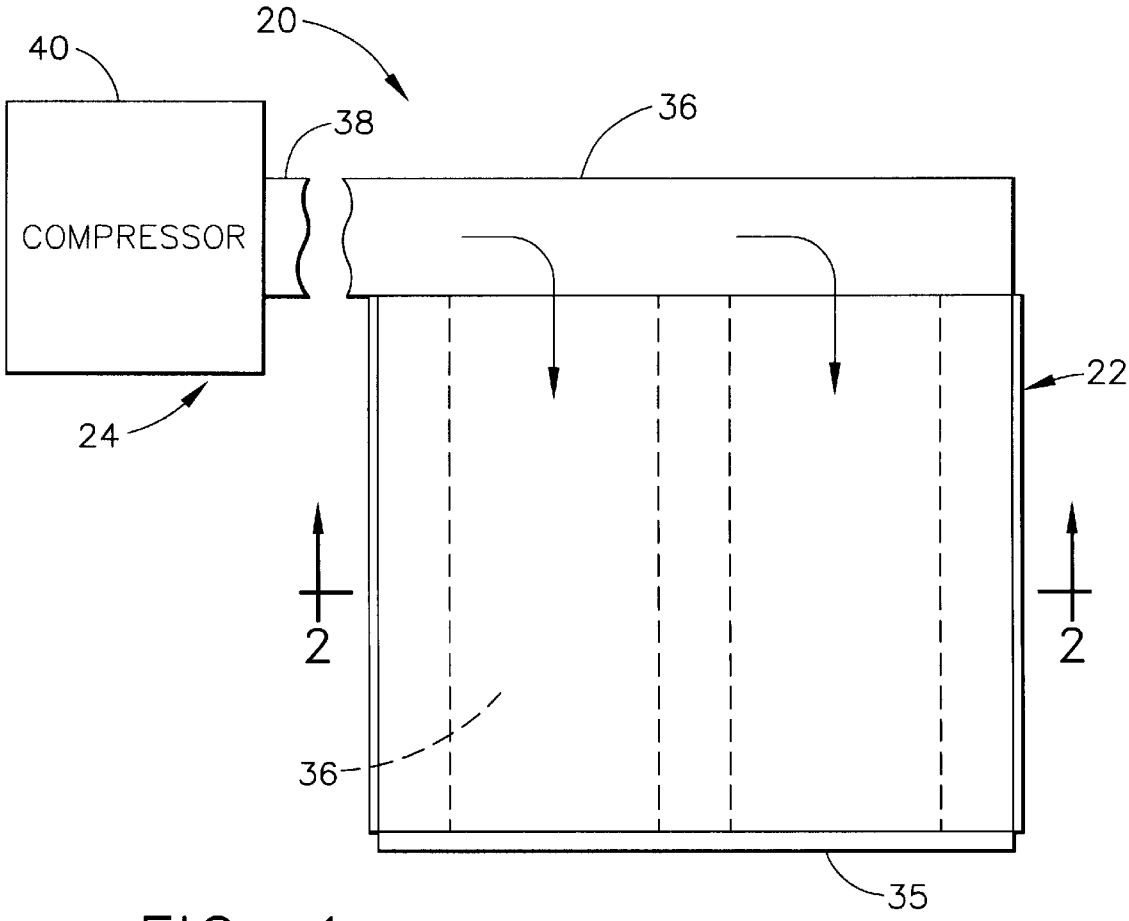
FIG. 1 is a schematic plan view of a structure incorporating a cooled article.
Figure 2:
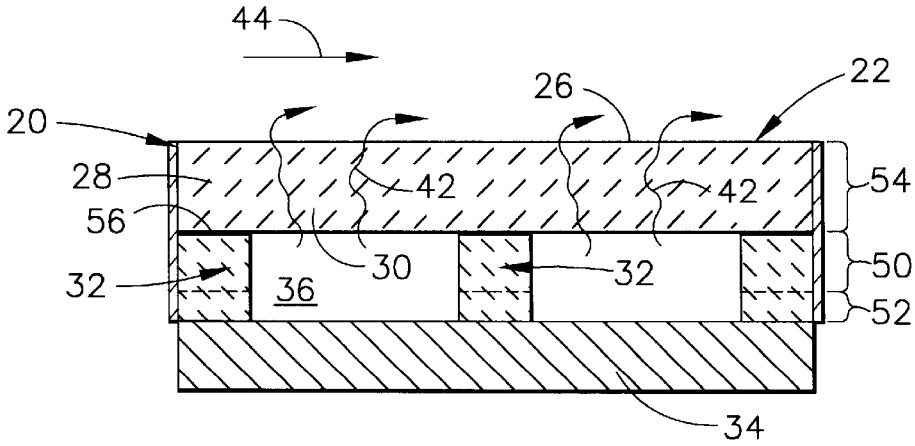
FIG. 2 is a sectional view of the cooled article of FIG. 1, taken along line 2—2.

FIGS. 1–2 illustrate a structure 20 including a cooled article 22 and a source 24 of a pressurized gas that is in gaseous communication with a portion of the cooled article 22. The cooled article 22 in FIGS. 1–2 is illustrated in a general form. It may be, for example, a component of an engine, such as a gas turbine engine, that has an exposed face 26 that contacts a flow of hot gas. One example of such a cooled article 22 is a stationary shroud positioned in facing relation to the high-pressure turbine blades of the gas turbine engine. (This "stationary shroud" is distinct from the rotating shroud found on some turbine blades.)

The cooled article 22 is formed at least in part of an open-cell solid foam material 28. As will be described in greater detail subsequently, the foam material 28 is a rigid body that has continuously interconnected internal porosity therein, so that gas may flow across and through the thickness of the foam material 28. The exposed face 26 of the foam material 28 contacts high-temperature gas. Provision is made to introduce a flow of cooling gas into an oppositely disposed source region 30 of the foam material 28. In the illustrated case, the cooled article 22 is formed with a spaced series of standoffs 32. In cooperation with a backing plate 34 and an end plate 35, these standoffs 32 define at least one gas plenum 36 which is in gaseous communication with the source region 30 and conducts cooling gas to the source region 30. As seen in the plan view of FIG. 1, the plenum 36 is in gaseous communication with a compressed gas output 38 of a gas compressor 40. The gas compressor 40 may be of any operable type, such as a conventional electric-powered compressor or the compressor section of a gas turbine engine that furnishes compressed bleed air for cooling.

In operation, gas compressed in the compressor 40 flows through the plenum 36 to the communicating source region 30 of the foam material 28. The compressed gas enters the porosity of the foam material 28 and flows from the source region 30, through the interior of the foam material 28, and toward the exposed face 26 as indicated by transpiration-gas-flow arrows 42. As the gas flows through the foam material 28, it closely contacts the foam material 28 and removes heat therefrom, a process termed transpiration cooling. Upon reaching the exposed face 26, the now-heated transpiration gas 42 leaves the foam material 28 and enters and mixes with a hot-gas flow 44. Because the hot gas 44 ordinarily flows at a high velocity generally tangential to the exposed face 26, the transpiration gas flow 42 typically joins this flow and moves approximately tangentially to the exposed face 26, thereby serving a film-cooling function in addition to the transpiration cooling function.

Figure 3:
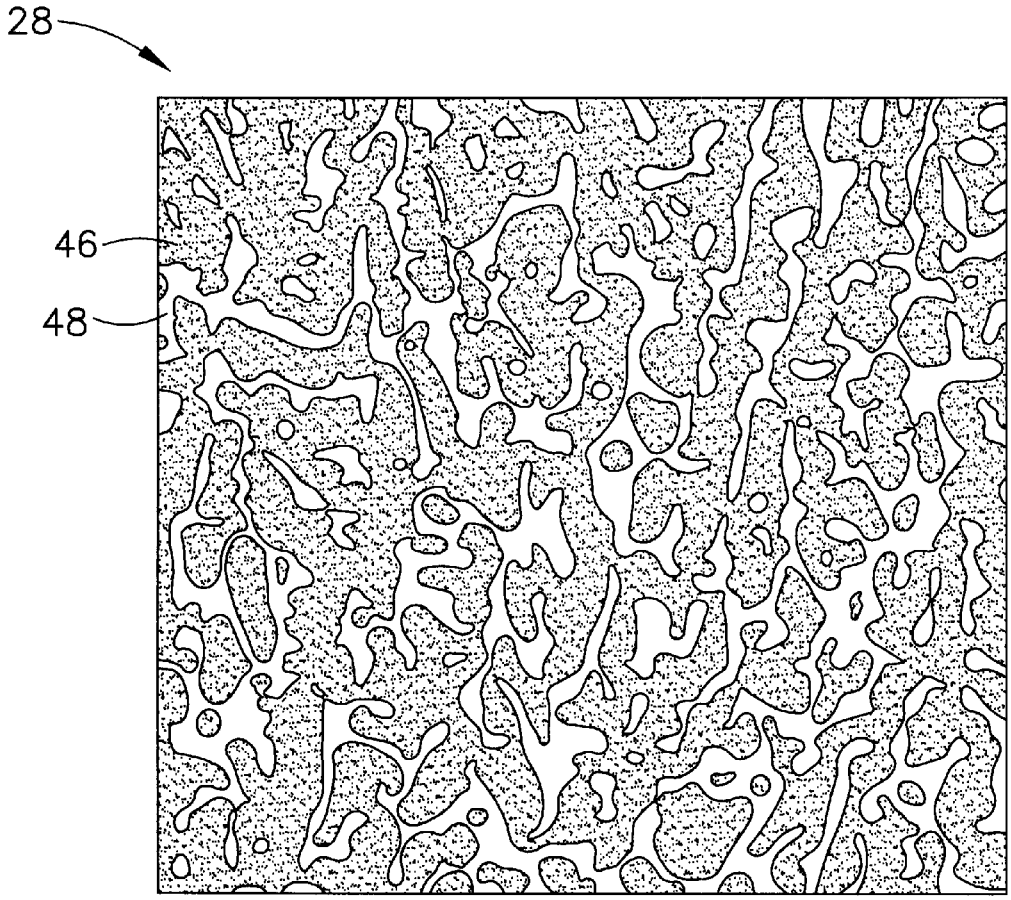
FIG. 3 is an idealized microstructure of an open-cell foam.

The foam material 28 is shown in greater detail in FIG. 3. The open-cell solid foam material comprises two interpenetrating, continuous regions 46 and 48. The region 46 is internally continuous within itself, and the region 48 is internally continuous within itself. A consequence of this structure is that either of the regions 46 or 48 may be removed in whole or in part to produce internal porosity within the foam material 28. The remaining region has a continuous, self-supporting structure which maintains its physical integrity and thence gives the foam material 28 the outward appearance and function of a solid body. Thus, for example, the region 46 may be removed in its entirety, and the remaining region 48 is a continuous skeletal structure. Alternatively, the region 48 may be removed in its entirety, and the remaining region 46 is a continuous skeletal structure.

In a preferred embodiment whose preparation will be described subsequently, prior to removal of some or all of one of the regions, the region 46 is a ceramic material that occupies at least about 60 volume percent of the ceramic foam material 26, most preferably from about 60 to about 80 volume percent of the ceramic foam material 26. The ceramic material comprises a base ceramic such as aluminum oxide. A modifying ceramic may be mixed with the base ceramic. Any compatible modifying ceramic may be used to achieve particular properties in the ceramic region 46, with the modifying ceramic present in an operable amount. For example, the modifying ceramic may be a ceramic material that is more abrasive than the base ceramic. Examples of abrasive modifying ceramics that are more abrasive than aluminum oxide and may be mixed with the aluminum oxide base ceramic are cubic boron nitride and sol gel alumina. The modifying ceramic may instead be a ceramic material that is less abrasive—that is, more abradable—than the base ceramic. Some examples of abradable modifying ceramics that are more abradable than aluminum oxide and may be mixed with the aluminum oxide base ceramic include silicon nitride and silicon carbide.

The region 48 occupies the remainder of the volume of the foam material 26. Because the region 48 occupies less than half of the total volume, it is difficult to see from a planar microstructure such as FIG. 3 that the individual portions of the region 48 are interconnected, but such is the case. The region 48 may comprise a metal, such as a nickel-base metal or an aluminum-base metal. It may contain a hard material that is relatively abrasive, such as an intermetallic compound or a refractive metal alloy, or it may contain a soft metal that is relatively abradable, such as the aluminum-base metal. As used herein, a disclosure of a metal of the region 48 includes both the pure form of the metal and its alloys. For example, "nickel" includes pure nickel and nickel-base alloys. As used herein, "metal-base" means that the composition has more of the named metal present than any other element. For example, a nickel-base alloy has more nickel than any other element. The nickel-base alloy may additionally be a nickel-base superalloy, meaning that it is of a composition which is strengthened by the precipitation of gamma-prime phase. A typical nickel-base alloy has a composition, in weight percent, of from about 1 to about 25 percent cobalt, from about 1 to about 25 percent chromium, from about 0 to about 8 percent aluminum, from 0 to about 10 percent molybdenum, from about 0 to about 12 percent tungsten, from about 0 to about 12 percent tantalum, from 0 to about 5 percent titanium, from 0 to about 7 percent rhenium, from 0 to about 6 percent ruthenium, from 0 to about 4 percent niobium, from 0 to about 0.2 percent carbon, from 0 to about 0.15 percent boron, from 0 to about 0.5 percent yttrium, from 0 to about 1.6 percent hafnium, balance nickel and incidental impurities.

Figure 4:
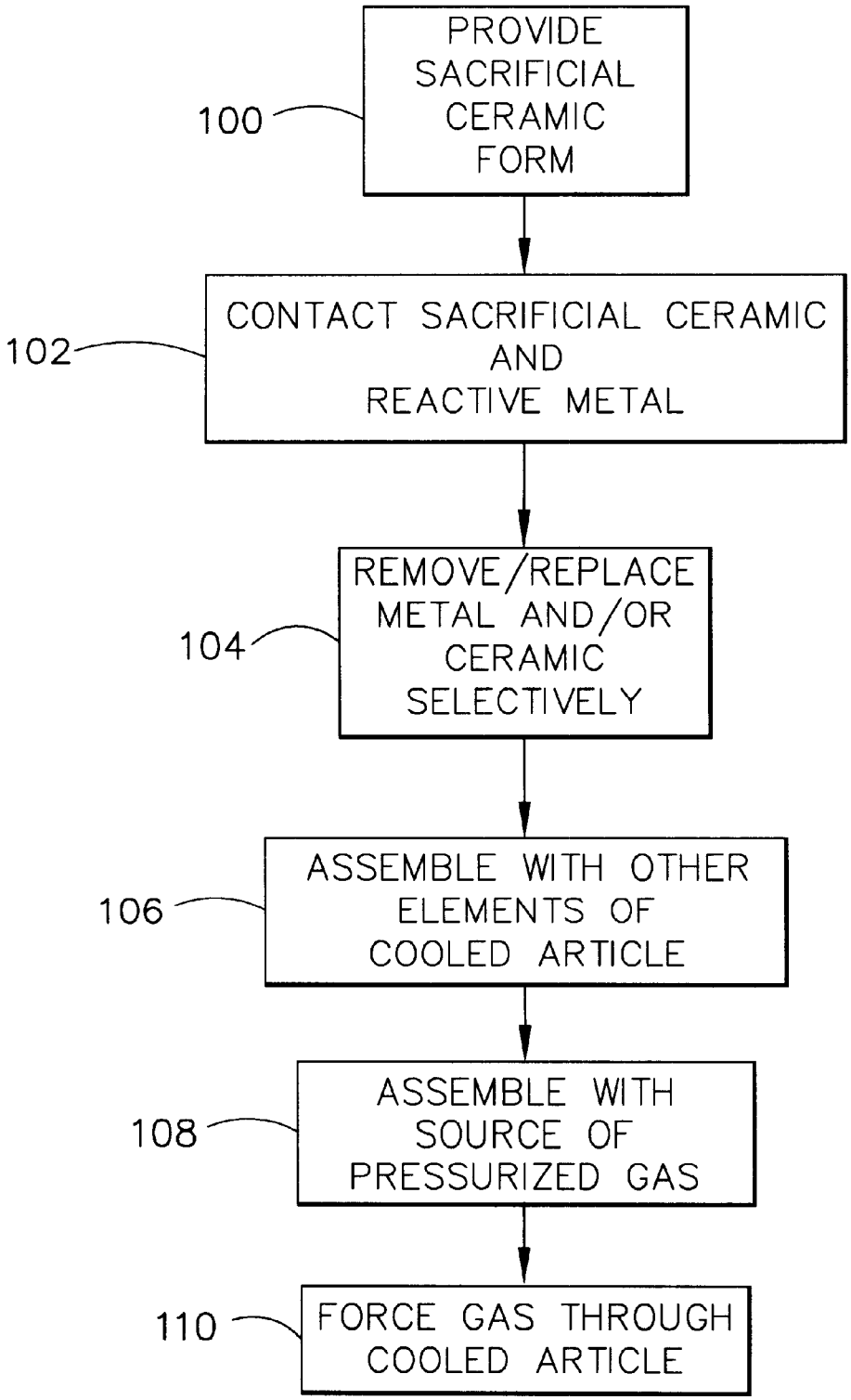
FIG. 4 is a block flow diagram of an approach for practicing the invention.

FIG. 4 illustrates a preferred approach for preparing and using the cooled structure 20. The cooled article 22 is preferably prepared using the general approach disclosed in U.S. Pat. Nos. 5,214,011 and 5,728,638, whose disclosures are incorporated by reference. A sacrificial ceramic form is prepared in the shape and size of the final cooled article 22, numeral 100. The sacrificial ceramic form is preferably made of silicon dioxide (silica) by slip casting or other operable technique. The sacrificial ceramic form is heated and fired to consolidate and fuse the silica particles.

The sacrificial ceramic form is thereafter immersed into a reactive metal, numeral 102, most preferably aluminum. The reactive metal may optionally be mixed with nonreactive metals such as a large fraction of nickel and other elements of the nickel-base alloy of interest for some applications, as disclosed in the '638 patent.

While the sacrificial ceramic form is immersed in the reactive metal, the ceramic of the sacrificial ceramic form is chemically reduced and the reactive metal is chemically oxidized. (Reduction and oxidation are broadly interpreted in the sense of electron transfer.) The reactive metal becomes an oxide or oxidized form, aluminum oxide in the preferred case. As a result of a mechanism involving volume changes and internal fracturing and discussed in the '011 patent, the foam or sponge structure is formed throughout the ceramic as it transforms from the sacrificial form-composition to the final composition. The intracellular volume that results is filled with a reaction-product metal.

Portions of the ceramic and/or the reaction-product metal may optionally be removed or replaced, numeral 104, as might be necessary for particular structures. Because each of the regions 46 and 48 is continuous, all or some of each of the regions 46 and 48 may be removed without affecting the other region. The metal in the intracellular volume 48 may be chemically removed by dissolution in an appropriate chemical. For example, aluminum may be removed by reaction with HCl or NaOH solutions. Some of the ceramic that forms the cell walls 46 may be chemically removed. For example, aluminum oxide may be removed by alkaline solutions such as KOH or NaOH, where aluminum has been previously replaced by a nickel-base alloy (as discussed next).

Portions of the aluminum metal may be replaced by immersing the aluminum/aluminum oxide composite material into a bath of the replacement liquid metal, such as a nickel-base or copper-base alloy. The composite material is maintained in the replacement liquid metal for a period of time, which depends upon the thickness of the composite material. This immersion allows diffusion to take place such that the aluminum is replaced by the liquid replacement metal from the bath. As an example, the aluminum/aluminum oxide composite material may be immersed in a nickel-base alloy for 8 hours at 1600° C. to effect the substantially complete replacement of the aluminum phase by the nickel-base alloy.

The material prepared in this manner forms the cooled article 22. The cooled article is assembled with other associated elements of structure, numeral 106. Such associated elements include, for example, the backing plate 34 and the end plate 35. This structure is assembled with the source of pressurized gas, including any required piping and the compressor 40, numeral 108. The compressor 40 is thereafter operated to force cooling air through the cooled article 22 to achieve transpiration cooling, numeral 110.

Figure 5:
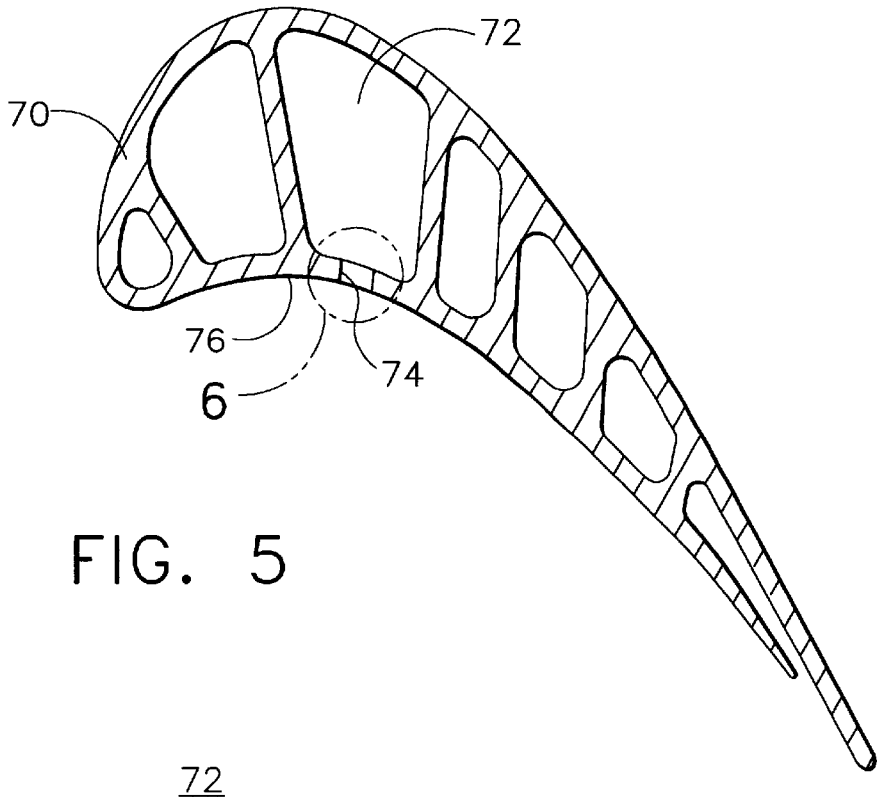
FIG. 5 is a sectional view of a turbine blade.
Figure 6:
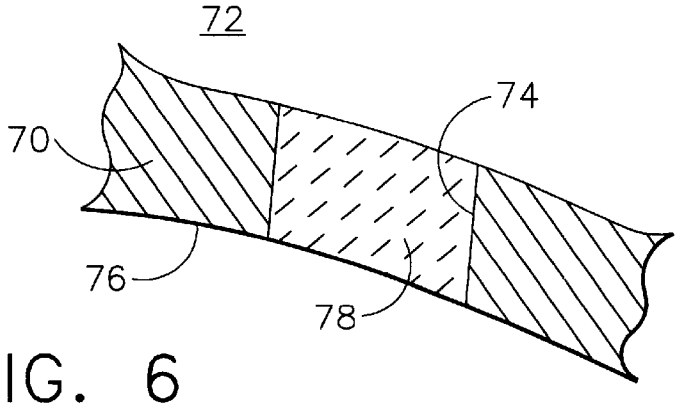
FIG. 6 is and enlarged detail of FIG. 5, taken in area 6, illustrating a first cooling approach.
Figure 7:
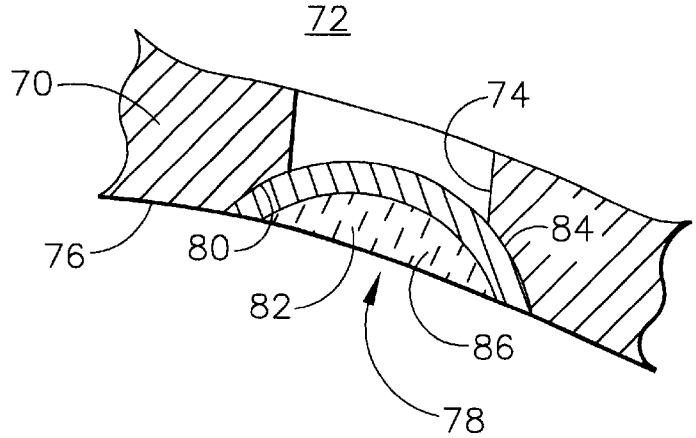
FIG. 7 is an enlarged detail of FIG. 5, taken in area 6, illustrating a second cooling approach.

The present approach has the important advantage that different portions of the regions 46 and 48 of the foam material 28 may be removed in different ways to achieve particular results, in step 104 of FIG. 4. Returning to the discussion of FIG. 2, the cooled article 22 may be prepared with different portions that provide different functionality. For example, the cooled article may first be prepared in step 102 with a ceramic first region 46 and a metal second region 48 comprising a nickel-base alloy. This structure is retained in a first portion 50 of the final cooled article 22. In a second portion 52, the ceramic of the first region 46 is removed, leaving a metallic foam structure. This metallic foam structure of the second portion 52 is adapted for joining to the backing plate 34, as by brazing with a braze metal. In a third portion 54, either the ceramic of the first region 46 is removed to leave a porous metallic foam, or the metal of the second region 48 is removed to leave a porous ceramic foam. Only one of the first region 46 and the second region 48—but not both—may be removed. The transpiration gas flow 42 passes through the porosity of the remaining phase. A seal coating 56 of a metal or ceramic may be applied if necessary to the sides of the cooled article 22 to prevent leakage of the cooling gas through the sides of the article through any porosity that has been created that might provide such a leakage path. FIGS. 1–2 illustrate one approach to the structure of a cooled article 22. Another approach is depicted in FIGS. 5–7 for a hollow turbine blade 70 having at least one internal gas plenum 72. At least one aperture 74 is provided from the plenum 72 to an external surface 76 of the turbine blade 70, in this case to the pressure or concave side of the turbine blade 70. There are usually multiple apertures 74, both spaced laterally along the external surface 76 and also spaced vertically out of the plane of the illustration of FIG. 5. Cooling gas is introduced into the plenum 72 at the root end of the turbine blade 70, and flows out of the apertures 74 to cool the external surface 76. Such a structure has been previously known, where the aperture 74 has no impediment therein to alter the flow of the cooling gas. Gas flows rapidly through the aperture 74 to form a film layer along the external surface 76.

FIG. 6 illustrates the use of a plug 78 in the aperture 74. The plug 78, which serves as a cooled article, is made of the foam material 28 with either the ceramic of the first region 46 or the metal of the second region 48 removed to render the foam material 28 porous. The cooling gas flows through this porous plug 78 at a lower velocity and greater residence time than through an open aperture. More heat is therefore transferred from the turbine blade 70 to the cooling gas by this transpiration cooling than possible in the absence of such a plug 78. The cooling gas that flows from the plugged aperture 74 also forms a cooling film in addition to achieving the transpiration cooling.

FIG. 7 illustrates an alternative form of the plug 78. In this approach, a groove 80 is formed in the external surface 76 extending in the direction out of the plane of the illustration in FIG. 7. The plug 78 takes the form of a long strip 82 of the porous foam material 28 that fits into the groove 80. The cooling gas flows through the aperture 74 and into the strip 82 of the porous foam material 28. The strip 82 acts as a diffuser to spread the cooling gas laterally and longitudinally, with the result that the cooling gas is spread over a much larger volume and surface area of the turbine blade 70 to achieve more effective cooling.

FIG. 7 also illustrates the versatility of this approach regarding the selective removal of ceramic and metal from the structure. In the strip 82, the ceramic is removed from the foam material 28 in a first portion 84 adjacent to the metal of the turbine blade 70, leaving a metal foam that facilitates the joining of the strip 82 to the turbine blade 70. The metal is removed from the foam material 28 in a second portion 86 in the central volume of the strip 82, leaving a ceramic foam that is resistant to degradation in the hot gas environment. As noted, this two-portion structure is not required, but is presented to illustrate the possibilities with this type of foam material 28.

An advantage of the present invention is that the size, shape, and/or dimensions of the cooled article, as well as its precursor structures, may be adjusted as necessary at any of several steps in the process. For example, the sacrificial ceramic form of step 100, which is silica in the preferred embodiment, may be reshape or resized by glass shaping techniques or machining. After the contacting step 102, or the steps 104 or 106, the cooled article may be coarse machined and/or fine machined to adjust its size and dimensions, or to add detail features.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A structure comprising a cooled article comprising an open-cell solid foam of cell walls having a porous interconnected intracellular volume therebetween, the cell walls being formed of a material selected from the group consisting of a metal and a ceramic, the cooled article having an exposed face, and a source region oppositely disposed from the exposed face, with the open-cell solid foam therebetween; and a source of a pressurized gas in communication with the source region of the cooled article, the pressurized gas flowing from the source region, through the open-cell solid foam, and out the exposed face of the cooled article.

2. The structure of claim 1, wherein the structure comprises a portion of an engine.

3. The structure of claim 1, wherein the structure comprises a portion of a gas-turbine engine.

4. The structure of claim 1, wherein the structure comprises at least a portion of a gas-turbine blade.

5. The structure of claim 1, wherein the structure comprises at least a portion of a gas-turbine stationary shroud.

6. The structure of claim 1, wherein the cell walls are a ceramic.

7. The structure of claim 1, wherein the cell walls are a metal.

8. The structure of claim 1, wherein the cell walls are a nickel-base metallic alloy.

9. The structure of claim 1, wherein at least some of the cell walls are a ceramic and some of the cell walls are a metal.

10. The structure of claim 1, wherein the source of the pressurized gas comprises a gas plenum in gaseous communication with the source region, and a compressor having a compressed gas output in gaseous communication with the gas plenum.

11. The structure of claim 1, wherein the cooled article is a plug.

12. A structure comprising a cooled article comprising an open-cell solid foam of ceramic cell walls having a porous interconnected intracellular volume therebetween, wherein the cooled article comprises at least about 60 volume percent of ceramic; and a source of a pressurized gas in communication with a source region of the cooled article, the source of the pressurized gas comprising a gas plenum in gaseous communication with the source region, and a compressor having a compressed gas output in gaseous communication with the gas plenum.

13. The structure of claim 12, wherein the ceramic comprises an aluminum oxide base ceramic material.

14. The structure of claim 12, wherein the cooled article is a plug.

15. The structure of claim 12, wherein the cooled article comprises from about 60 to about 80 percent by volume of ceramic.

16. A structure comprising a cooled article comprising an open-cell solid foam of ceramic cell walls having a porous interconnected intracellular volume therebetween, wherein the ceramic comprises an abrasive ceramic mixed with a base ceramic, the abrasive ceramic being more abrasive than the base ceramic; and a source of a pressurized gas in communication with a source region of the cooled article, the source of the pressurized gas comprising a gas plenum in gaseous communication with the source region, and a compressor having a compressed gas output in gaseous communication with the gas plenum.

17. The structure of claim 16, wherein the cooled article is a plug.

18. A structure comprising a cooled article comprising an open-cell solid foam of ceramic cell walls having a porous interconnected intracellular volume therebetween, wherein the ceramic comprises an abradable ceramic mixed with a base ceramic, the abradable ceramic being more abradable than the base ceramic; and a source of a pressurized gas in communication with a source region of the cooled article, the source of the pressurized gas comprising a gas plenum in gaseous communication with the source region, and a compressor having a compressed gas output in gaseous communication with the gas plenum.

19. The structure of claim 18, wherein the cooled article is a plug.

20. A method of preparing a structure including an open-cell solid foam article, the method including the steps of providing a piece of a sacrificial ceramic having the shape of a cooled article, and contacting the piece of the sacrificial ceramic with a reactive metal which reacts with the sacrificial ceramic to form an open-celled ceramic foam article comprising ceramic cell walls of an oxidized ceramic of the reactive metal, and a porous interconnected intracellular volume therebetween filled with an intracellular metal;

removing at least a portion of one of the ceramic cell walls and the intracellular metal of the article to form a transpiration volume; and placing a source of a pressurized gas in gaseous communication with a source region of the transpiration volume of the cooled article.

21. The method of claim 20, wherein the structure comprises a portion of an engine.

22. The method of claim 20, wherein the cell walls of the transpiration volume are a ceramic.

23. The method of claim 20, wherein the cell walls of the transpiration volume are a metal.

* * * * *